US005395211A

United States Patent [19]

Johnson

[11] Patent Number: 5,395,211

[45] Date of Patent: Mar. 7, 1995

[54] STATOR STRUCTURE FOR A ROTARY MACHINE

[75] Inventor: Thomas E. Johnson, Wallingford, Conn.

[73] Assignee: United Technologies Corporation, Hartford, Conn.

[21] Appl. No.: 182,254

[22] Filed: Jan. 14, 1994

[51] Int. Cl.[6] ..... F01D 25/26

[52] U.S. Cl. ..... 415/209.2; 415/9

[58] Field of Search ..... 415/9, 137, 139, 209.2, 415/209.3, 209.4

[56] References Cited

U.S. PATENT DOCUMENTS

| | | | |
|---|---|---|---|
| 2,942,844 | 6/1960 | Neate | 415/137 |
| 3,243,158 | 3/1966 | Desmond | 419/9 |
| 3,727,660 | 4/1973 | Burge | 415/209.3 |
| 4,566,851 | 1/1986 | Comeau et al. | 415/139 |
| 4,756,153 | 7/1988 | Roberts et al. | 415/137 |
| 5,096,377 | 3/1992 | Catte et al. | 415/9 |

FOREIGN PATENT DOCUMENTS

| | | | |
|---|---|---|---|
| 629149 | 9/1949 | United Kingdom | 415/209.3 |

*Primary Examiner*—Edward K. Look
*Assistant Examiner*—Michael S. Lee
*Attorney, Agent, or Firm*—Gene D. Fleischhauer

[57] ABSTRACT

A stator assembly 14 having a spline-type connection between an inner case 24 and an outer case 26 is disclosed. Various construction details are developed, which ensure that the spline-type connection permits relative radial growth between the inner case and the outer case while providing for a rigid interconnection between the cases during blade failures which transfer loads from the outer case to the inner case. In one particular embodiment, the inner case has attached thereto a plurality of spline-type spacers 54 each having an inwardly facing surface 82 which is adapted to engage an outwardly facing surface 74 on a portion of the support structure for the outer case to restrain the outer case against radially outward movement.

10 Claims, 3 Drawing Sheets

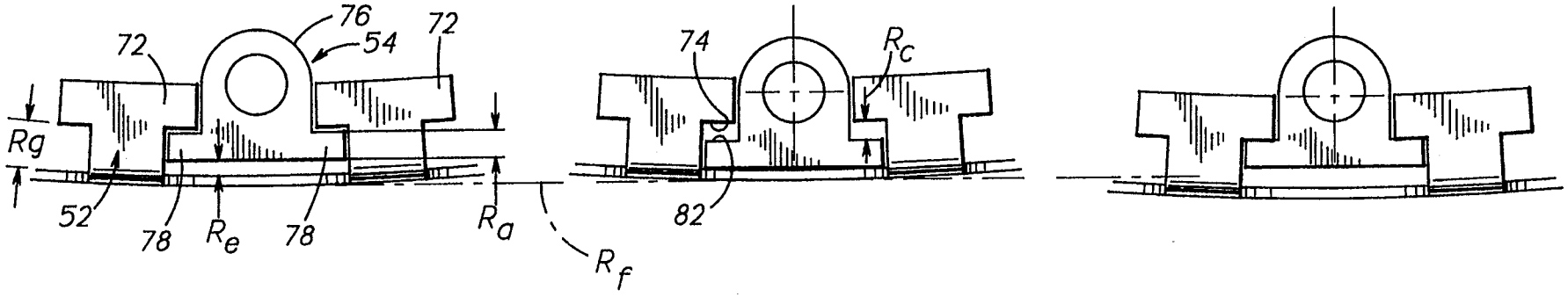
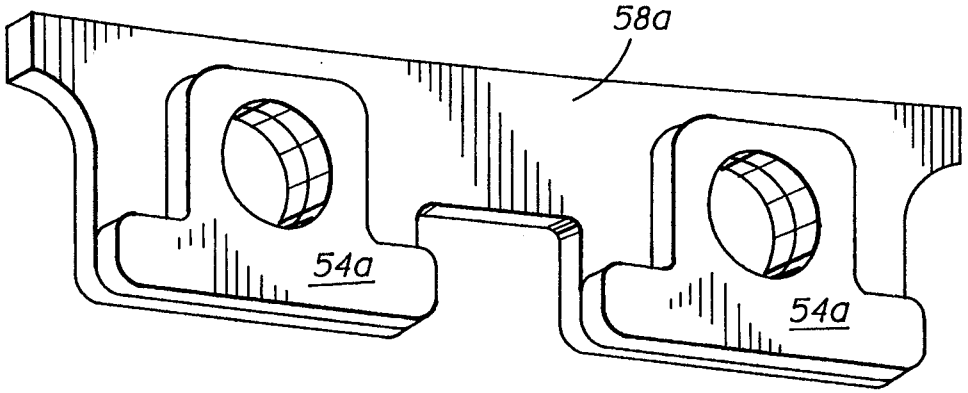
FIG. 4

STATOR STRUCTURE FOR A ROTARY MACHINE

TECHNICAL FIELD

This invention relates to a stator structure for a rotary machine and more particularly, to a support assembly extending between an inner case and an outer case.

BACKGROUND ART

One example of a rotary machine for an aircraft is the turbofan, gas turbine engine. The engine includes a compression section, a combustion section, and a turbine section. A primary flowpath for working medium gases extends axially through these sections of the engine. The flowpath is annular in shape. A stator assembly extends circumferentially about the annular flowpath to bound the flowpath. A rotor assembly extends axially through the engine inwardly of the casing between the compression section and the turbine section.

Under operative conditions, working medium gases are drawn into the compression section. The gases are passed through several stages of compression, causing the temperature and pressure of the gases to rise. The pressurized gases are mixed with fuel in the combustion section and burned to form even hotter, pressurized gases. These gases are a source of energy to the engine and are expanded in the turbine section to produce work.

A secondary flowpath for working medium gases is disposed outwardly of the primary flowpath. The secondary flowpath is also annular in shape. The secondary flowpath is bounded by an outer duct wall and an inner duct wall. The inner duct wall of the secondary flowpath may provide an outer casing which extends circumferentially about the sections of the engine. One example of such a turbofan engine is the JT8D model turbofan engine manufactured by Applicant's assignee. In the JT8D engine, a second or inner case is spaced radially inwardly of the outer casing (inner duct wall) and provides the pressure vessel for containing the working medium gases on the interior of the engine. As a result, the inner casing has a circumferential hoop-strength characteristic which is greater than the circumferential hoop-strength characteristic of at least a portion of the outer casing. The hoop-strength characteristic is a measure of the ability of the casing to resist circumferential stresses. In this construction, a circumferential bracket extends between the inner case and the outer case and is integrally attached to both to positively support the outer case from the inner case.

The rotor assembly is used to transfer energy from the hot working medium gases of the primary flowpath in the turbine section to the compression section. In the compression section, the energy is transferred to working medium gases drawn into the compression section to compress the incoming gases. The rotor assembly includes a rotor disk in the turbine section and arrays of rotor blades which extend outwardly across the working medium flowpath in the turbine section to receive energy from the gases. The expanding gases in the turbine section are flowed over the radially extending rotor blades and drive the rotor assembly about the axis of rotation. Arrays of rotor blades in the compression section extend outwardly from the rotor assembly and are driven by the rotor assembly about the axis of rotation to compress the working medium gases drawn into the compression section.

Heat is transferred from the high-temperature gases in the turbine section to components in the turbine section, such as the inner case and, to a lesser extent, to the outer case. The temperature in the outer case, which is remote from the hot working medium gases and to some extent cooled by the passage of gases in the secondary flowpath over the outer case, is much less than the temperature of the inner case.

The inner case expands outwardly toward the outer case because of the difference in temperature between the inner case and the outer case, and the higher coefficient of thermal expansion of the inner case in comparison with the outer case. The difference in thermal growth has caused cracking of the support bracket which extended between the inner case and the outer case and was rigidly attached to both in early constructions of the JT8D engine.

One solution to the cracking problem while providing positive support to the outer casing (or inner duct) from the inner casing was to provide a spline-type connection between the inner case and the outer case. This permitted the inner case to grow radially with respect to the outer case while positively supporting the outer case with the inner case through the spline-type connection.

Positively supporting the outer case from the inner case increases the capability of the gas turbine engine to contain blade failures. In axial-flow rotary machines, the rotor assemblies are driven at high rotational speeds about the axis of rotation. Occasionally a blade may fail, for example, when a foreign object is ingested into the engine or the fatigue life of the blade is exceeded. During such a failure, pieces of the rotor assembly may be hurled outwardly from the rotor assembly with velocities of several hundred feet per second. The inner case and the outer case in such circumstances must stop the particles to avoid having the particles from the rotor assembly cause damage to other portions of the engine.

The above art notwithstanding, scientists and engineers working under the direction of Applicant's assignee have sought to improve the durability and containment capability of these casing structures.

DISCLOSURE OF INVENTION

This invention is in part predicated on the realization that providing a spline-type connection between an inner case and an outer case decreases the containment capability of the structure. And, that the decrease in containment capability results, in part, from a loss in load sharing between the relatively strong inner case and the weaker portions of the outer case which was made possible by a rigid connection between the inner case and the outer case.

According to the present invention, a gas turbine engine having an inner case and an outer case is provided with a support assembly extending between the cases which has a spline-type connection and structure having radially facing surfaces which engage after limited movement of the spline to retain the outer case with the inner case and provide load sharing between the cases during a blade failure.

In one particular embodiment of the present invention, the spline-type connection is formed by spline-type spacers and a bracket having a plurality of spline gaps for the spacers, the bracket being attached to one of the cases and having an outwardly facing radial surface adjacent the spline gap which is aligned with an inwardly facing radial surface on the spacer such that abnormal movement of the outer case outwardly in response to an impacting particle forces the radially facing surfaces into engagement to reinforce the outer case with the strength of the inner case.

In one particular embodiment, the spline-type spacer has a T-shaped configuration and indisposed in grooves between T-shaped, tab-like projections on the bracket such that the arms of each T engage in response to outward, abnormal movement of the outer case.

A primary feature of the present invention is a spline-type connection between an inner case and an outer case. The inner case has a hoop-strength characteristic which is greater than the hoop-strength characteristic of the outer case. Another feature is a spline gap formed by pairs of circumferentially spaced projections on the bracket. Another feature of the present invention is radially facing surfaces on a spline-type spacer and on the tab-shaped projections which define the spline gap. In one particular embodiment, the tab-like projection has a T-shape and the spacer has a spline-type portion disposed in a spline gap formed by the T-shaped projections. The spacer has a T-shaped portion which engages arms of the T-shaped projection of the bracket under abnormal operative conditions of the engine. In one embodiment, the projection has an axially extending portion. Still another feature is a retainer plate. The retainer plate constrains movement of the bracket and spline-type spacer in the axial direction. In one embodiment, a feature is a pair of spline-type spacers which are integrally joined to the retainer plate.

A primary advantage of the present invention is the durability of the support structure extending between an inner case and an outer case which results from the spline-type connection between the cases. Another advantage is the containment capability which results from the engagement between the inner case and the outer case once the outer case has deflected outwardly away from the inner case. In one embodiment, an advantage is the ability of the bracket to accommodate a sudden outward movement of the outer case which results from the radial gap between the inwardly facing surface of the spline-type spacer and the outwardly facing surface of the bracket at the spline-type connection and the level of axial stiffness of the axially extending portion of the projection. In one detailed embodiment, an advantage is the positive positioning of the spline-type spacers with respect to the bracket which results from integrally attaching the spacers to a retaining plate in the uninstalled condition.

The foregoing features and advantages of the present invention will become more apparent in light of the following detailed description of the best mode for carrying out the invention and in the accompanying drawings.

BRIEF DESCRIPTION OF DRAWINGS

FIG. 3*a*, FIG. 3*b*, and FIG. 3*c* is a schematic representation of two T-shaped projections on a bracket and a spline-type spacer showing the relative position of the spacer in the non-operative condition (FIG. 3*a*), under an operative condition causing radial outward movement of the inner case and its spline-type spacer (FIG. 3*b*) and under a failure operative condition causing radial outward movement of a portion of the outer case in response to a blade failure.

FIG. 4 is a partial perspective view of a retainer plate integrally joined with a pair of spline-type spacers in an uninstalled condition.

BEST MODE FOR CARRYING OUT THE INVENTION

Figure 1:
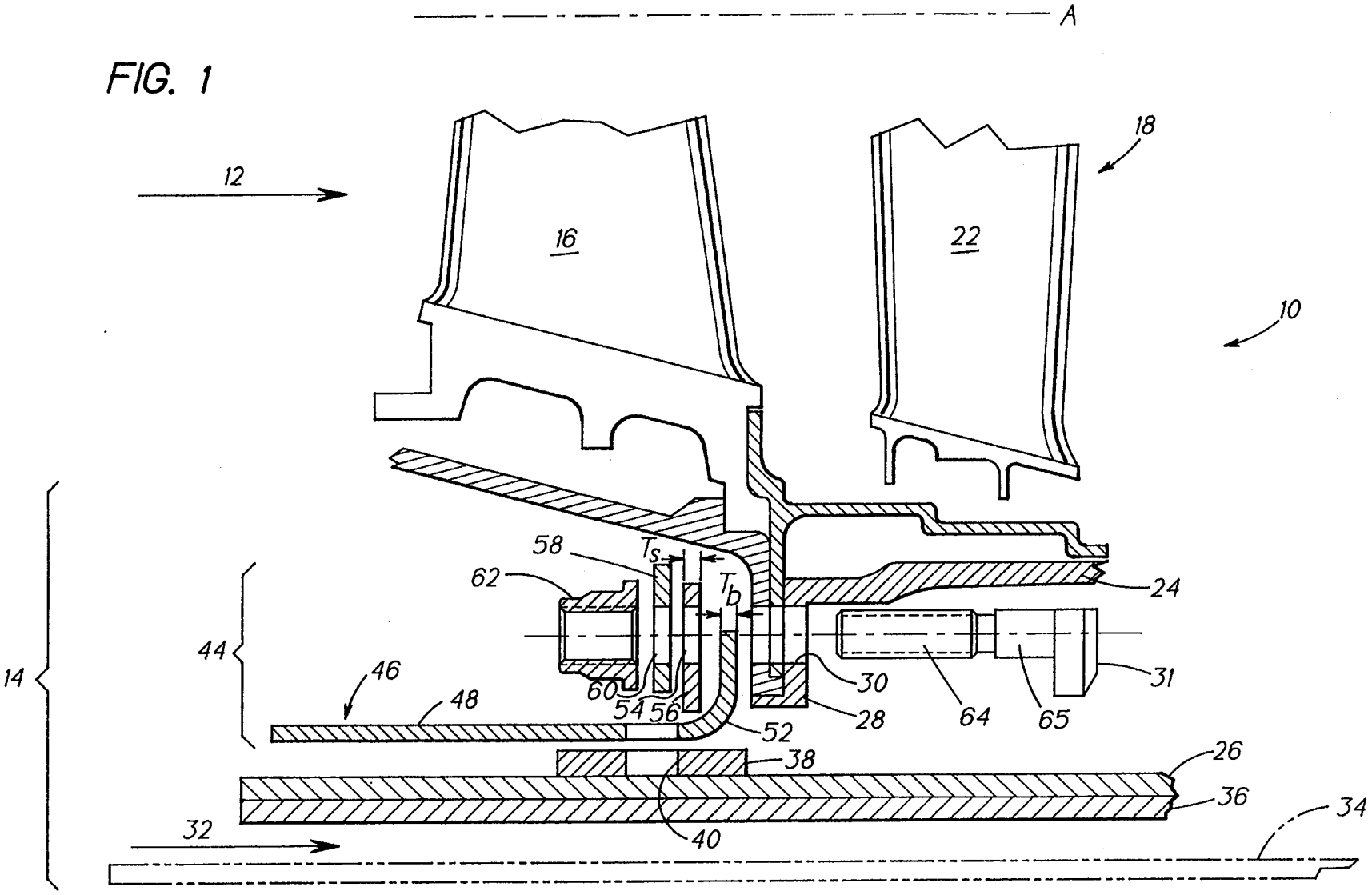
FIG. 1 is a side elevation view of a portion of the turbine section of a gas turbine engine showing an inner case, an outer case, an array of stator vanes, and an array of rotor blades.

FIG. 1 is a side-elevation view of a portion of a rotary machine 10 such as a gas turbine engine. The rotary machine has an annular flowpath 12 for primary working medium gases which extends axially through the rotary machine. A stator assembly 14 extends circumferentially to bound the flowpath for working medium gases. The stator assembly includes a plurality of stator vanes 16 which extend radially inwardly across the working medium flowpath. A rotor assembly 18 extends axially through the engine. The rotor assembly is disposed about an axis of rotation A of the engine. The rotor assembly includes an array of rotor blades, as represented by the single rotor blade 22. The array of rotor blades extend radially outwardly across the working medium flowpath into close proximity with the stator assembly.

The stator assembly 14 includes stator structure which includes an inner case 24 and an outer case 26. The inner case has a flange 28 which extends circumferentially about the inner case. The flange has a plurality of holes 30 which adapt the inner case to receive a first plurality of fasteners 31. In the embodiment shown, the inner case is represented by the low pressure turbine case which is the pressure vessel for the primary flowpath 12 for working medium gases. Accordingly, the inner case has a relatively large hoop-strength characteristic in comparison to the outer case.

As shown in FIG. 1, the gas turbine engine includes a secondary flowpath for working medium gases 32 which extends axially through the engine outwardly of the primary flowpath for working medium gases 12. The secondary flowpath is inwardly bounded by the outer case 26 and outwardly bounded by the outer duct wall 34 (shown in phantom). The outer case is commonly referred to as the inner duct wall. In early constructions, the inner duct wall did not perform a containment function. In the embodiment shown, the inner duct wall is reinforced by an additional layer of material for containment purposes as represented by the member 36. In the present constructions, the inner duct wall may be formed without an additional layer of material but of a one-piece thicker material that is thicker than is normally used in similar constructions in the past to increase the containment capability of the inner duct wall. The inner duct wall has a hoop-strength characteristic that is less than the hoop-strength characteristic of the inner case even though it is reinforced or thickened.

The outer case (inner duct wall) 26 has a circumferentially extending reinforcement band 38 which extends about the interior of the outer case. The outer case and reinforcing band 38 include radial holes 40 which are circumferentially spaced and which adapt the outer case to receive a second plurality of fasteners such as a plurality of nut and bolt means (not shown).

A support assembly 44 extends between the outer case 26 and the inner case 24. The support assembly includes a bracket 46 which extends circumferentially about the interior of the outer case. The bracket may be a one-piece construction or formed in two or more cylindrically-shaped segments which are each attached to the outer case by the second plurality of fasteners. The bracket has a cylindrically shaped first section 48 which is circumferentially continuous between the circumferentially spaced holes 40. The first section extends inwardly of the outer case in an axial direction. The first section is integral with (and in the embodiment shown is integrally attached to) the outer case. As used herein, integral and integrally attached means that the device so formed or so attached acts as one piece with the adjacent structure. A plurality of tab-like projections 52 extend axially from the first section of the bracket toward the flange 28 of the inner case 24.

A plurality of spline-type spacers 54 are each interdigitated with the plurality of tab-like projections 52 as shown in FIG. 3, which will be discussed below. Each spline-type spacer has a hole 56 extending therethrough. The hole extends in the axial direction. The hole adapts the spacer to receive a bolt from the first plurality of fasteners 31 for integrally attaching the spacer to the flange 28 of the inner case.

The support assembly 44 includes a plurality of retainer plates 58. Each retainer plate faces the flange 28 and has at least two holes therethrough as represented by the single hole 60. These holes are aligned with a pair of corresponding circumferentially spaced holes 30 in the flange 28.

The first plurality of fasteners 31 is represented by the single nut and bolt means. Each fastener includes a nut 62 and bolt 64 having a shaft 65 which passes through associated holes in the retainer plate 58, the spline-type spacer 54 and the flange 28. The nut and bolt urge the spacer against the flange and trap the bracket between the flange and the retainer plate to integrally attach the spacer to the flange. The axial thickness $T_s$ of the spline-type spacers is greater than the axial thickness $T_b$ of the bracket, leaving an axial clearance between the retainer plate and the flange. This permits radial movement between the spline-type spacer and the bracket.

Figure 2:
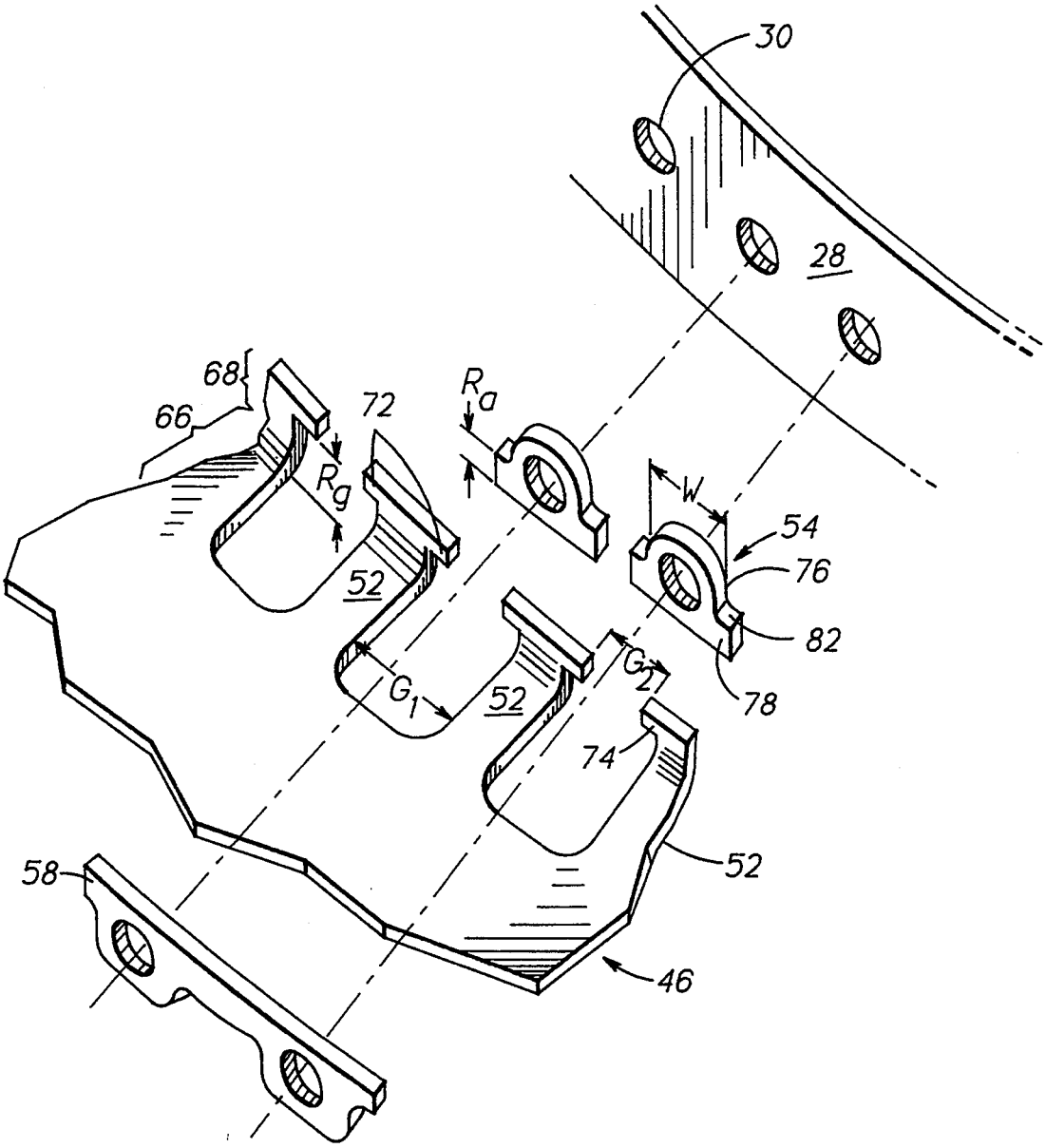
FIG. 2 is a partial perspective view which is exploded to show a flange portion of the inner case and a support assembly which extends between the inner case and the outer case.

FIG. 2 is a simplified perspective view of the structure shown in FIG. 1 which is exploded to illustrate the relationship of the bracket 46 to the spline-type spacers 54 and the retainer plate 58. As shown in FIG. 2, the tab-like projections 52 of the bracket 46 are circumferentially spaced one from the other leaving a first gap $G_1$ therebetween. Each projection has a first portion 66 and a second portion 68. The first portion 66 extends axially toward the flange 28. The second portion extends radially inwardly toward the axis A. Each second portion 68 of the bracket has a pair of arms, as represented by the arms 72. Each arm extends circumferentially from a circumferentially facing side of the second portion of the bracket toward the adjacent arm, leaving a circumferential spline gap $G_2$ therebetween. The circumferential spline gap $G_2$ is smaller than the first gap $G_1$ such that each arm 72 has an outwardly facing surface 74 which radially bounds a portion of the first gap $G_1$.

Each spacer 54 has a first portion 76 having a width W. The first portion adapts the spacer to be disposed in an associated spline gap $G_2$ between a pair of projections 52 on the bracket to form a spline-type connection between the outer case and the inner case. Each spacer has a pair of arms 78 which adapt the spacer to be disposed in first gap $G_1$. Each arm extends circumferentially in the gap $G_1$ and has an inwardly facing surface 82 which faces in a radial direction opposite to the outwardly facing surface 74 on the tab-like projection. The radial height $R_a$ of the arm of the spacer is less than the radial height $R_g$ of the gap $G_1$.

FIG. 3*a*, FIG. 3*b*, and FIG. 3*c* illustrate the relationship of the T-shaped projections 52 to the spline-type spacers 54 during three operative conditions of the engine. As shown, the spacers are axially aligned with the projections such that the inwardly facing surface 82 on the spline-type spacer is aligned with the outwardly facing surface 74 on the tab-like projection 52.

FIG. 3*a* is a view of the relationship of the arms 78 of the spline-type spacer 54 to the arms 72 on the tab-like projection 52 in the installed condition. The broken line $R_f$ is a reference line tangent to the inner duct wall (outer case) 26 at a location outwardly of one of the spacers. FIG. 3*a* shows the relationship of the spline-type spacer 54 to the bracket in the installed position prior to the operation of the engine. The radial height $R_a$ of the arms of the spline-type spacer is less than the radial height $R_g$ of the gap $G_1$ leaving an expansion space $R_e$ between the outermost portion of the spline-type spacer and the innermost portion of the outer case.

FIG. 3*b* shows the relationship of the spline-type spacer to the T-shaped projections after an operative condition at which the spline-type spacer has moved radially outwardly with respect to the T-shaped projections in response to engine temperatures. As shown, the outermost portion of the spline-type spacer is adjacent to the duct wall. The radial gap $R_e$ between the spline-type spacer and the duct wall is negligible but a gap $R_e$ has opened between the bracket and the innermost portion of the arms on the spacer.

FIG. 3*c* shows the relationship of the spline-type spacer 54 to the outer case after an abnormal operative condition resulting from an impact of a particle against the outer wall. The impact has displaced the wall radially outwardly, causing the inwardly facing surface 82 of the spline-type spacer to engage the radially outwardly facing surface 74 of the T-shaped projection on the bracket. This engagement restrains the wall against further outward movement.

FIG. 4 shows an alternate embodiment of the spline-type spacer 54 and the retainer plate 58. The retainer plate 58 is integrally attached by welding, bonding, or the like to a pair of spline-type spacers 54*a*. The spacers are positively positioned and aligned by the retainer plate. The retainer plate and spline-type spacers are integrally joined to the flange 28 of the inner case by the nut and bolt combination.

During operation of the gas turbine engine shown in FIG. 1, hot working medium gases are flowed along the working medium flowpath 12. As a result of the temperature of the gases, the inner case 24 is heated to a temperature that is greater than the temperature of the outer case 26. As a result, relative radial growth takes place between the inner case and the outer case with the inner case moving radially outwardly toward the outer case. The spline-type connection between the inner case and the outer case which is provided by the support assembly 44 allows this relative radial movement to occur without imposing bending stresses on the bracket or imposing hoop stresses on the outer case. As a result, this radial growth is accommodated without injuring the outer case which has a relatively smaller circumferential hoop strength than does the inner case and without cracking the bracket of the support assembly.

The relative radial movement outwardly of the spline-type spacer decreases the radial gap $R_e$ from its initial height shown in FIG. 3*a* to a very negligible height shown in FIG. 3*b*. This opens up a radial gap $R_e$ which provides for a pre-determined amount of movement of the outer case and support assembly outwardly. The movement is limited to the amount $R_e$. Thereafter, further movement is resisted by the inner case, transferring loads from the outer case to the inner case. For example, during a failure operative condition in which a rotor blade 22 separates and moves outwardly penetrating the inner case, the outer case is available to restrain further outward movement of the blade. The impact of the blade drives the outer case outwardly as shown in FIG. 3*c* until the tab-like projections 52 engage the spline-type spacer at a plurality of locations around the circumference of the outer case. The impact load is transferred in part to the inner case, decreasing local hoop stresses in the outer case which has a smaller hoop-strength characteristic than the inner case. This increases the containment capability of the outer case transferring a portion of the load on the outer case to the inner case. As a result, better containment capability of the structure results.

A particular advantage of this construction is the fan duct acting as a rigidly attached structure to the inner casing during a blade failure to perform a containment function while still permitting relative radial growth between the inner case and the outer case under normal operative conditions. This is made possible by the radial engagement of the inwardly facing surface 82 on the spacer 54 engaging the outwardly facing surface 74 of the T-shaped projections on the bracket. Such a construction may be readily retrofitted to an existing engine with the inner duct wall being increased in thickness in comparison to the prior duct wall.

In the embodiment shown, a particular advantage is the axially extending first portion 66 of the bracket 46 which is relatively weak in the radial direction by reason of the circumferentially extending gap $G_1$ between adjacent first portions. As a result, these projections can deflect outwardly in response to loads on the bracket providing for the more gradual build-up of stress in the outer casing.

In the embodiment shown, another advantage is the shape of the spacer and tab-like retainer. The spacer is relatively rectangular with the circumferential span of the spacer being equal of the gap $G_2$ between the circumferentially extending arms of the bracket. This positively traps the spacer in the projection, with the projection resisting twisting of the spacer about the bolt 64. A particular advantage of the construction shown is FIG. 4 is the positive positioning during assembly of the spline-type spacers which results from attaching them to the retainer plate. Another advantage is increased resistance of the spacer to twisting or bonding from a sudden radial load on the spacer. The load is transmitted to some extent from one spacer to the retainer plate and the adjacent spacer through the retainer plate. In addition, the projections restrain prevents the spline-type spacer from twisting about the axis of the nut and bolt means which positively attaches the spacer to the inner flange. As a result, the orientation of the spacer is always maintained with respect to the bracket even under the most severe operating condition of a blade failure providing the spacer is securely fastened to the retainer.

Although the invention has been shown and described with respect to detailed embodiments thereof, it should be understood by those skilled in the art that various changes in form and detail may be made without departing from the spirit and scope of the claimed invention.

I claim:

1. A stator structure for a rotary machine, the rotary machine having an annular flowpath for working medium gases, having a stator assembly which extends circumferentially to bound the flowpath for working medium gases, and having a rotor assembly having an axis of rotation A and an array of rotor blades which extend radially outwardly across the working medium flowpath into close proximity with the stator assembly, the stator structure which comprises:

an inner case which extends circumferentially about the working medium flowpath to bound the flowpath for working medium gases, the inner case having a first hoop strength characteristic;

an outer case spaced radially outwardly from the inner case, the outer case having a second hoop strength characteristic which is less than the first hoop strength characteristic over at least a portion of the outer case;

a support assembly which extends between the outer case and the inner case and which has structure integral with both of said cases, the support assembly including a spline type connection having a plurality of spline gaps which are circumferentially spaced and which extend radially in the structure integral with one of said cases, the structure having a surface at each gap which faces in a first radial direction, and a plurality of splines attached to the structure integral with the other of said cases, each spline extending axially, having a surface which faces in a second radial direction opposite to the first radial direction and being disposed in an associated spline gap;

wherein the spline type connection permits the inner case to position the outer case about the inner case and to move radially outwardly a radial distance $R_e$ with respect to the outer case under normal operative conditions that cause expansion of the inner case in response to temperatures of the working medium flowpath, and wherein the radial surfaces are radially aligned such that the outer case is restrained against further radial movement outwardly at each spline type connection once the outer case has moved radially outwardly a distance equal to or greater than the distance $R_e$ as might occur during a rotor blade failure which penetrates the inner case and impacts the outer case.

2. The stator structure of claim 1 wherein one of said surfaces faces radially inwardly and is integrally attached to the inner case and the other of said surfaces faces radially outwardly and is attached to the outer case.

3. The stator structure of claim 2 wherein the spline gaps are disposed in the structure integrally attached to the outer case and the splines are integrally attached to the inner case.

4. The stator structure of claim 1 wherein the stator structure includes a plurality of spline type spacers, the inner case has a circumferentially extending flange, the outer case has a plurality of projections, each of which extends radially inwardly to bound the spline gaps and has the surface which faces outwardly in a radial direction, and the stator structure further includes a plurality of retainer plates, each retainer plate being spaced axially from the flange and trapping axially the projection against the flange, wherein each spacer is integrally attached to the inner case, said spacer having one of said splines and having an arm extending from the spacer which has the surface which faces radially inwardly, and wherein a pair of spline type spacers are integrally attached to the retainer in the uninstalled condition to locate positively the spline type spacers with respect to the projection and to prevent rotation of the spacer and misalignment of the spacer in the installed condition under operative conditions of the engine.

5. The stator structure of claim 4 wherein each projection has a first portion which extends axially and a second portion which is the portion which extends radially, and wherein the axially extending portion has reduced radial stiffness in comparison to the radially extending first portion to impart radial flexibility to the support assembly.

6. The stator structure of claim 1 wherein the stator structure includes a plurality of spline type spacers, the inner case has a first section and a circumferentially extending flange, and the outer case has integral therewith a first section and a plurality of projections, each of which has a T-shape formed by a portion which extends radially inwardly from the first section and is spaced circumferentially by a gap $G_1$, and a pair of arms each of which extends circumferentially from the portion toward the adjacent arm leaving the circumferential spline gap $G_2$ therebetween to form the top portion of the T, the circumferential width of the gap $G_2$ being smaller than the gap $G_1$, each of the arms having one of the surfaces which faces outwardly and wherein each spacer is integrally attached to the inner case, has one of said splines and has a pair of arms extending circumferentially from the spacer to form a T-shape and wherein each arm of the spacer is disposed in the gap $G_1$ and has one of the surfaces which faces radially inwardly toward the surface which faces radially outwardly on the arm of the projection and is spaced radially inwardly from the first section by a distance $R_e$ in the operative condition and is spaced outwardly from the arm of the projection by a radial gap $R_e$ in the non-operative condition to permit expansion of the inner case outwardly with respect to the outer case by a distance $R_e$ and the outer case outwardly with respect to the inner case by a distance which is equal to or greater than the radial gap $R_e$ to permit only a limited amount of movement of the outer case radially outwardly in response to an impact by reason of the engagement of the radial surfaces.

7. The stator structure of claim 6 wherein the support assembly further includes a bracket which is cylindrical in shape and which is divided into two halves, each integrally attached to the outer case, the bracket having the first section and the T-shaped projections which extend radially inwardly to bound the spline gaps $G_2$.

8. A stator structure for a rotary machine, the rotary machine having an annular flowpath for working medium gases, having a stator assembly which extends circumferentially to bound the flowpath for working medium gases, and having a rotor assembly having an axis of rotation A and an array of rotor blades which extend radially outwardly across the working medium flowpath into close proximity with the stator assembly, the stator structure comprising:

an inner case which extends circumferentially about the working medium flowpath to bound the flowpath for working medium gases, the inner case having a first hoop strength characteristic and a flange which extends circumferentially about the case, the flange having a plurality of holes extending through the flange which adapt the flange to receive a plurality of nut and bolt means;

an outer case spaced radially outwardly from the inner case, the outer case having a second hoop strength characteristic which is less than the first hoop strength characteristic over at least a portion of the outer case;

a support assembly which extends between the outer case and the inner case, the support assembly including a bracket which extends circumferentially about the interior of the outer case, the bracket having a cylindrically shaped first section which extends axially inwardly of the outer case and which is integrally attached to the outer case, a plurality of tab-like projections which extend axially from the first section toward the flange of the inner case and which are circumferentially spaced one from the other leaving a first gap $G_1$ therebetween, each projection having a first portion which extends axially and a second portion which extends radially inwardly and which has an axial thickness $T_b$, each second portion having a pair of arms, each of which extend circumferentially from a side of the second portion toward the adjacent arm leaving a circumferential spline gap $G_2$ therebetween which is smaller than the first gap $G_1$ such that the arm has an outwardly facing surface which radially bounds the first gap, a plurality of spline type spacers, each spacer having a hole extending therethrough in the axial direction and being adapted by the hole to receive a bolt for integrally attaching the spacer to the flange, the spacer being disposed in an associated spline gap between a pair of projections on the bracket to form a spline type connection between the outer case and the inner case, the spacer having an axial thickness $T_s$ which is greater than the axial thickness $T_b$ of the projection, the spacer having a pair of arms disposed in the first gap $G_1$ , each spacer arm extending circumferentially in the gap $G_1$ and having an inwardly facing surface which faces in the radial direction toward the outwardly facing surface on the second portion of the tab-like projection, the radial height $R_a$ of the arms being less than the radial height $R_g$ of the gap $G_1$, a plurality of retainer plates, each retainer plate facing the flange and having at least two holes therethrough which are aligned with a pair of circumferentially spaced holes in the flange, the retainer plate and flange trapping the second portion of the bracket and the spline type spacer in the axial direction;

a plurality of nut and bolt means, each having a shaft which passes through the associated holes in the spline type spacer and the flange for urging the spacer against the flange, trapping the second portion of the bracket between the flange and the retainer, and integrally attaching the spacer to the flange;

wherein the spline type connection positions the outer case from the inner case and the difference in axial thickness between the spacer and the second portion of the bracket permits relative movement between the bracket and the spacer in the radial direction to accommodate radial growth of the inner case outwardly with respect to the outer case, wherein the engagement between the arms of the spline type spacer and the second portion of the bracket limits outward movement of the outer case with respect to the inner case under abnormal operative conditions such as a containment operative condition and permits load sharing between the outer case and the relatively strong inner case and wherein the first portion of each projection which extends axially has reduced stiffness in the radial direction in comparison to the second portion of the tab like projection which extends radially and is deflectable outwardly to accommodate a sudden movement outwardly during a containment operative condition.

9. The stator structure of claim 8 wherein a pair of spline type spacers are integrally attached to the retainer in the uninstalled condition to locate positively the spline type spacers with respect to the bracket and to prevent rotation of the spacer and misalignment of the spacer in the installed condition under operative conditions of the engine.

10. The stator structure of claim 9 wherein the annular flowpath for working medium gases is a primary flowpath and the stator structure further includes a secondary flowpath for working medium gases outwardly of the primary flowpath for working medium gases, wherein the outer case is an inner duct wall, the rotary machine being an existing rotary machine and the inner duct wall being a replacement duct wall having a portion radially outwardly of the array of rotor blades, the portion being reinforced by having increased radial thickness in comparison to the thickness of the prior duct wall and the support assembly is a replacement support assembly for a prior spline type support assembly, the reinforced portion of the duct wall cooperating with the replacement support assembly to increase the effectiveness of the outer case against an impact during a containment operative condition of the machine in comparison to the prior support assembly and the prior inner duct wall.

* * * * *